United States Patent [19]

Hotchkin

[11] 4,450,594

[45] May 29, 1984

[54] TANK DISPENSER WITH END-OF-LIFE INDICATOR

[75] Inventor: Peter Hotchkin, Rochester, N.Y.

[73] Assignee: The R. T. French Co., Rochester, N.Y.

[21] Appl. No.: 490,777

[22] Filed: May 2, 1983

[51] Int. Cl.[3] ..... E03D 9/02

[52] U.S. Cl. ..... 4/228; 4/227; 116/200; 116/228; 222/23

[58] Field of Search ..... 4/228, 227, 222; 116/208, 200, 211, 228; 215/366; 222/23, 416, 51

[56] References Cited

U.S. PATENT DOCUMENTS

| | | | |
|---|---|---|---|
| 874,393 | 12/1907 | Collins | 215/366 |
| 3,583,005 | 6/1971 | Kilby, Jr. | 4/228 |
| 3,867,101 | 2/1975 | Harring | 4/228 X |
| 3,877,081 | 4/1975 | Klein | 4/228 X |
| 4,248,827 | 2/1981 | Kitko | 4/228 X |
| 4,308,625 | 1/1982 | Kitko | 4/227 X |
| 4,350,666 | 9/1982 | Klutts | 4/227 X |
| 4,380,772 | 4/1983 | Haliano | 222/23 X |

*Primary Examiner*—Henry K. Artis

*Attorney, Agent, or Firm*—Shlesinger, Fitzsimmons & Shlesinger

[57] ABSTRACT

A disc-shaped, soluble, chlorine base tablet is supported in a disposable plastic container on the upper ends of a pair of spaced partitions, which extend between the sidewalls of the container adjacent its midpoint. Movably mounted between the partitions beneath the tablet is an inverted, cup-shaped member, which has a water soluble dye cast or otherwise secured in its closed, upper end. The container has therein a pair of vertically spaced ports, and is adapted to be mounted in an upright position adjacent the bottom of a conventional toilet tank so that the lower port in the container permits a limited amount of water to flow in and out of the container each time the tank is flushed. After repeated flushings the water soluble tablet dissolves to a point where it permits the inverted cup member to float upwardly in the container, and to swing towards its upright position so that water in the container flows into engagement with the dye compositions. The dye then dissolves and is dispensed with the flushing water into the toilet bowl to provide a visible indication that the container should be replaced.

15 Claims, 5 Drawing Figures

TANK DISPENSER WITH END-OF-LIFE INDICATOR

BACKGROUND OF THE INVENTION

This invention relates to a device for automatically cleaning toilets, and more particularly to a dispenser which is suspended in a toilet tank or water closet automatically to dispense small quantities of a cleansing and/or disinfectant compound into the tank water each time that the toilet is flushed. Even more particularly, this invention relates to a novel dispenser which contains means for automatically indicating that the dispenser has reached the end of its life and is in need of replacement.

If there is a particular chore which housewives are pleased to avoid, it appears to be the need for cleaning household toilets. For this reason a great many products have been developed for the intended purpose of automatically washing or cleansing a toilet bowl each time the associated toilet is flushed. Typically such products comprise a ported housing or dispenser containing a water treating compound, and designed to be suspended in a toilet tank automatically to dispense small, concentrated quantities of the compound into the tank water each time the toilet is flushed.

For example, U.S. Pat. No. 3,618,143 discloses a dispenser having two, interconnected compartments, one of which (the larger) contains a solid, water soluble composition, and the other of which is ported in such manner as to permit only a small portion of the composition to be introduced into the tank water with each flushing of the associated toilet. In the dispenser disclosed in U.S. Pat. No. 3,504,384, both a cleaning compound and a separate disinfecting compound are employed, and the dispenser is divided into two completely separate compartments so that the respective compounds are kept separated from each other until such time that they are introduced into the tank water. Similar such dispensers, although slightly different in configuration, can be found in U.S. Pat. Nos. 4,208,747 and 4,305,162.

Most tank dispensers of the type described are of the disposable variety and contain water treating compounds which become exhausted after repeated flushing of the associated tank. Because they are normally hidden from view, it is desirable that such dispensers include some means for indicating when their water treating compounds have become exhausted and require replacement. The water treating compounds of some dispensers are premixed with a colored dye, and are designed normally to admit a small quantity of the dye into the tank water each time that the tank is flushed. In practice the intensity of the dye decreases as the water treating contents of the dispenser become exhausted, so that in theory the householder should be able to note the disappearance of the dye and realize that the dispenser should be replaced.

On the other hand, there are dispensers which use transparent tank water cleaning and/or disinfecting materials which do not discolor the flush water. For this type of dispenser efforts have been made to provide an end-of-life indicator which, when the cleansing and/or disinfectant compound in the dispenser has expired, will suddenly release an intense, colored die, or the like, to warn the householder that it is time to replace the dispenser. U.S. Pat. No. 3,867,101, for example, discloses a dye tablet which is specifically designed to dissolve very slowly over a prolonged period of time. Its composition is carefully selected so that its rate of dissolution, prior to emitting the dye, is substantially equal to that of the associated water treating compound, so that at least in theory the dye will be released approximately at the same time that the water treating compound has expired. The disadvantage of this construction, obviously, is that it is extremely difficult to design an end-of-life tablet which will dissolve at a desired rate under vrious conditions of operation.

An alternative suggested in U.S. Pat. No. 3,583,005 is to employ a water-soluble dye layer, which is located at the bottom of the dispenser where, theoretically, it will not come into contact with water in the tank until an overlying oil base disinfectant and deodorant product has been exhausted after prolonged flushing of the tank. The disadvantage of this dispenser is that extreme care must be taken to provide a water-soluble layer which will not be attacked or otherwise react with the overlying disinfectant/deodorant prior to the time that the latter become exhausted.

It is an object of this invention, therefore, to provide an improved tank dispenser of the type described having relatively simple and inexpensive means for automatically indicating when the cleansing/disinfecting compound in the dispenser has expired.

A further object of this invention is to provide a dispenser of the type described in which the end-of-life indicator is positively retained in an inoperative position by a solid, water soluble cleansing/disinfecting composition until such time that the latter has approached a predetermined point of exhaustion.

Other objects of the invention will be apparent hereinafter from the specification and from the recital of the appended claims, particularly when read in conjunction with the accompanying drawing.

SUMMARY OF THE INVENTION

The dispenser comprises a plastic housing disposed to be suspended in the water tank or reservoir of a conventional toilet or water closet. A partition, which extends transversely of the housing adjacent one side thereof, divides its interior into a large chamber for holding a chlorine tablet, and a smaller chamber which communicates at opposite ends with the larger chamber. The smaller chamber has therein a pair of vertically spaced ports for permitting a predetermined amount of water to flow into and out of the housing each time the associated toilet is flushed. In one embodiment the chlorine tablet is retained by spaced partitions over the top of an inverted, generally cup-shaped holder having cast or otherwise housed in the bottom thereof a water soluble dye, which normally is prevented from coming into contact with water in the housing because of an air bubble which fills the lower end of the holder.

The chlorine tablet is heavier than water so it normally retains the holder in its inverted position where the dye is prevented from coming into contact with the water. However, after the chlorine tablet has dissolved to a predetermined size, as for example just before it becomes necessary to replace the dispenser, the chlorine tablet permits the holder to float upwardly in the housing and suddenly to rotate from its inverted toward an upright position, thus permitting air to escape from the lower end of the holder and allowing water to come into contact with the dye to dissolve the latter. Consequently, the next time that the toilet is flushed the water discharged from the dispenser will carry with it the water soluble dye, thereby to provide a visual indication that the time has come to replace the dispenser.

Instead of a colored dye a perfumed fragrance or the like could be cast or otherwise retained in solid, water-soluble form in the bottom of the inverted holder, thereby to release a fragrance into the water, rather than a dye, when the table has become small enough to permit the holder to float upright.

THE DRAWING

DETAILED DESCRIPTION OF THE PREFERRED EMBODIMENT

Figure 1:
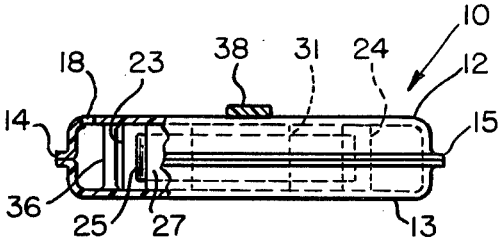
FIG. 1 is a plan view of a tank dispenser made according to one embodiment of this invention, portions of the dispenser being cut away and shown in section for purposes of illustration.

Referring now to the drawing by numerals of reference, and first to FIGS. 1 to 3, 10 denotes generally a flat, nearly rectangularly shaped dispenser or housing having a pair of spaced, parallel sidewalls 12 and 13 marginal edges of which are curved inwardly and seamed together around the entire periphery of the dispenser to form thereon parallel side seams 14 and 15, a transverse bottom seam 16, and an inclined upper or top seam 17. Two vertically spaced ports or openings 18 and 19 are formed in the dispenser adjacent seam 14. Although in the embodiment illustrated both ports 18 and 19 are formed in the wall 12, it is to be understood that both ports could be formed in the wall 13 if desired, or alternatively one port could be formed in each of the walls. As noted hereinafter, the upper port 18, which is positioned adjacent the intersection of seams 14 and 17, functions as a vent, while the lower port 19 is used to admit water into, and to permit water to flow out of, the interior of the dispenser.

Secured to an extending transversely between walls 12 and 13 adjacent the bottom seam 16 are two, spaced, tablet-supporting partitions 21 and 22. The lower portions of partitions 21 and 22 extend parallel to each other and are positioned approximately equidistantly from opposite sides of the center line of the dispenser, while the upper ends of these partitions flare outwardly as at 23 and 24, respectively. Cradled between the confronting surfaces of the upper, inclined ends of the partitions 21 and 22 is a solid, disc-shaped water treating tablet 25, the composition of which is discussed in greater detail hereinafter. Tablet 25, which is water soluble, is positioned beneath another partition 27, which extends transversely between the side walls 12 and 13 at right angles to the side seams 14 and 15. As shown more clearly in FIG. 2, partition 27 extends only part way across the width of the dispenser 10 so that opposite ends thereof are spaced inwardly from the side seams 14 and 15.

Mounted beneath the tablet 25 for vertical sliding movement between the confronting, parallel surfaces formed on the lower ends of partitions 21 and 22 is an inverted, cup-shaped member 31. The lower, open end of member 31 is rectangularly shaped in cross section, and its upper, closed end 32 (FIG. 2) is segmental-hemispherical in configuration. Cast or otherwise secured in the bore of the cup member 31 against its upper, closed end is a solid, water soluble dye composition which is denoted in FIG. 2, by the numeral 34.

The dispenser 10 also contains an elongate baffle 36, which extends transversely between the walls 12 and 13 parallel to seam 14, and between the tablet 25 and the ports 18, 19. As shown more clearly in FIG. 2, the baffle 36 is shorter than the overall height of the dispenser, and is centered so that opposite ends thereof are disposed in spaced, confronting relation to the lower and upper dispenser seams 16 and 17, respectively. Moreover, baffle 36 is located just to the left of the partition 21, 23, so that it is operatively disposed between the tablet 25 and the adjacent port 19, so that the flow of water in and out of this port will not create any undue turbulence in that portion of the dispenser interior which houses the tablet 25.

In use the dispenser is adapted to be suspended in a toilet tank by means of a flexible, foldable strap 38, or the like, one end of which is fastened to one side of the dispenser (side 12 in the illustrated embodiment), and the other end of which can be folded over the upper end of a toilet tank in known manner. The dispenser may be completely immersed in the toilet tank so as to be located upright near the bottom of the tank, or it can be suspended so that its lower end projects downwardly into the water in the tank at least to a point where its lower port 19 will be positioned below the uppermost level L (FIG. 2) of the water in the tank, when the latter is filled. Assuming the dispenser is suspended as in FIG. 2, rising water in the tank will enter the dispenser through the port 19, thereby causing air within the dispenser to be discharged out of the upper port 18. Since the upper port 18 is maintained above the upper water level L of the tank when the dispenser is suspended as in FIG. 2, the tank water will be free to flow in through port 19 to fill the dispenser to a level equal to that of the full tank level L.

When the associated toilet is flushed, the level of the tank water drops downwardly beneath the lower end of the suspended dispenser 10, thereby permitting the quanity of water in the dispenser above the port 19 to flow out of the port 19 into the tank water to be discharged into the associated toilet bowl. Obviously when the level L in the tank drops below the port 19 the dispenser 10 retains all of the water therein which lies below the port 19. Since the port 19 is positioned above the upper end of the tablet 25, it will be apparent that the tablet 25 remains immersed in water even when the tank is flushed.

Figure 2:
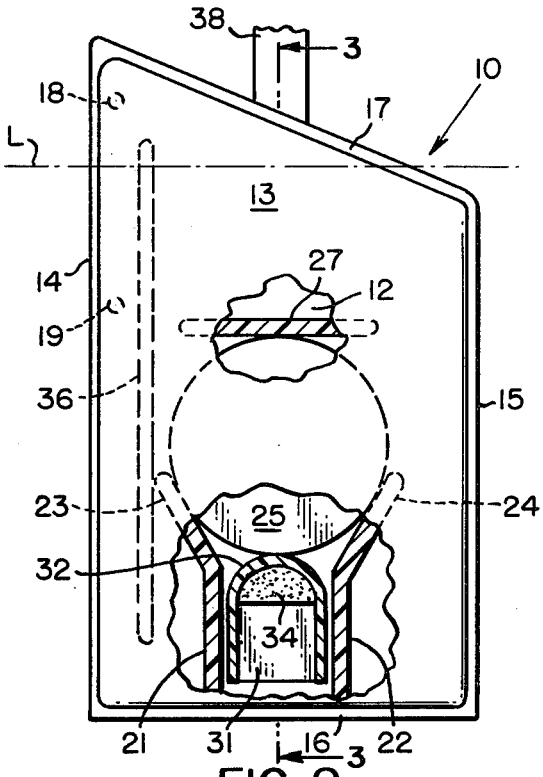
FIG. 2 is a front elevational view of this dispenser, portions thereof again being cut away and shown in section for purposes of illustration.

In practice the tablet 25 may be made from a conventional chlorine base compound, such as for example that which is commonly known in the trade by the acronym TCCA. The chlorine tablet 25 serves the dual purpose of cleansing the associated toilet bowl, and holding the inverted cup element 31 in its operative position as illustrated in FIG. 2 until such time that the tablet 25 has nearly expired. Then, as noted hereinafter, the air bubble which is trapped in the lower end of the cup element 31 overcomes the weight of the tablet 25 and causes the element 31 to rise upwardly from between the confronting surfaces on the partitions 21 and 22 into the space between the upper, flared ends 23 and 24 of the partitions. At this point the cup element is free to swing its lower end upwardly in the dispenser at least far enough to permit the air bubble in its lower end to be displaced by water, which then comes into contact with the dye composition 34 eventually to dissolve the composition and permit the dye therein to flow out of the dispenser into the tank water.

In practice the cup element 31 may be made from a plastic material having a specific gravity (s.g.) of 1.0. The dye composition 34 in the bottom of the cup 31 may be comprised of a surfactant tablet with blue dye sufficiently chlorine resistant to retain color for at least twenty-four hours in a 1.0% chlorine solution. It may have an s.g. of approximately 1.2, and may be present in a quantity of approximately 2 grams. The density of the chlorine tablet 25, on the other hand, may be approximately 3.1, and for a tablet 32 mm in diameter and 6 mm thick it would therefore weigh approximately 15 grams. The result is that the chlorine tablet 25 bears downwardly on the cup element 31 to retain it in its inoperative position (FIG. 2) until after repeated flushings have caused the overall size of tablet 25 to reach a point where it no longer can hold the cup element 31 in its inverted position. At that time, therefore, the cup 31 will float upwardly in the water in dispenser 10, and aided by its hermispherically shaped closed end, will swing upright, thereby releasing the air bubble from its lower end and allowing water in the dispenser to flow into operative engagement with the dye composition 34. Depending upon its resistance to the chlorine solution, therefore, the dye shortly thereafter begins during flushing to flow from the port 19 into the tank water, thereby providing the housekeeper with a visual indication that the chlorine tablet has expired and that the dispenser should be replaced.

A primary advantage of this construction is that the air pocket or bubble, which is confined in the lower end of the inverted cup 31, prevents water in the dispenser 10 from coming into contact with the dye composition 34 until such time that the chlorine tablet 35 has substantially expired. Therefore, regardless of repeated flushings, and irrespective of changes in temperature and the rate of water flow through the dispenser 10, the dye composition 34 remains isolated from the water until the cleaning and/or disinfecting tablet has reached the end of its life. For this reason it is not necessary that the composition 34 be covered by a chlorine resistant material. However, if desired, a thin layer of such material could be utilized temporarily to delay release of the dye for a predetermined period of time after the cup 31 flow upwardly in the dispenser and swings in its upright position.

Still another advantage of this construction is its simplicity. Although water is free to flow or circulate completely through the interior of the dispenser 10, it is prevented from entering the lower end of the inverted cup 31 by virtue of the air bubble which exists in the cup from the moment that the dispenser is inserted into the toilet tank. Simply by proper selection of the size and weight of the chlorine tablet 25, the cup 31 is caused to be retained in its inverted, inoperative position until the dispenser tablet 25 has expired.

Among the compositions 34 which have been found to be suitable for use with the invention, and which may constitute dyes or dispensable pigments, are those that are sold by Pylam Products of New York, N.Y. under the trademarks "PYLAKLOR DRY BLUE", "PYLAKLOR PERMANENT GREEN", and "PYLAKLOR FAST BRIGHT BLUE". These dye stuffs are readily water soluble, and their rates of solubility and ease of dispersing can be adjusted by the addition of soluble inorganic salts and/or the addition of surface active agents. By way of example such agents may include, among others, an alkylaryl sulfonate sold by Petrochemical, Inc. under the trademark "PETRO AG".

Figure 3:
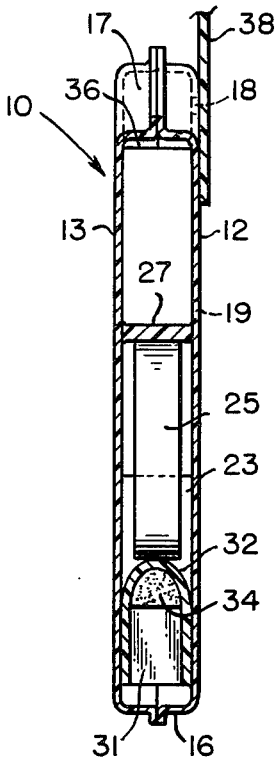
FIG. 3 is a fragmentary sectional view taken generally along the line 3—3 in FIG. 1 looking in the direction of the arrows.

While the preferred embodiment of the cup-shaped holder 31 is shown in FIGS. 1 to 3, it will be apparent that the exact configuration of the cup 31 may differ without the departing form this invention. For example, the cup could be conical in configuration, whereby the chlorine tablet 25 would rest against the pointed, upper end of the cup; or alternatively, the cup could be cylindrical or cubical in configuration.

Figure 4:
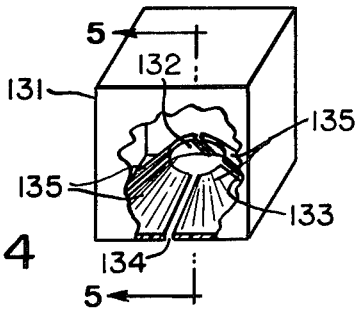
FIG. 4 is an enlarged perspective view of a modified type of dye holder which can be employed with this invention, part of the holder being cut away and shown in section.
Figure 5:
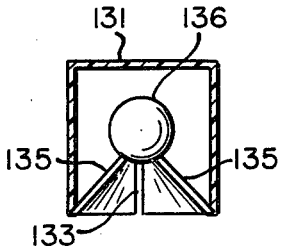
FIG. 5 is a sectional view taken generally along the line 5—5 in FIG. 4 looking in the direction of the arrows and showing how a dye tablet is mounted inside of this holder.

As an alternative to casting or otherwise securing the dye composition 34 in the bottom of the cup 31, it would be possible to use a modified cup element 131 (FIGS. 4 and 5), which generally has the configuration of a rectangular box, except that the bottom wall of the box has therein a circular opening 132, and is divided by two intersecting slots 133, 134, which effectively divide the bottom into four sectors 135. These sectors 135 can be bent upwardly into a truncated-conical configuration to support on the upper ends thereof a spherically shaped dye pill or tablet 126, which may have a composition similar to that denoted at 34.

It should be noted that the lower ends of partitions 21, 22 need not extend all the way to the bottom seam 16 of container 10, because even if water is permitted to pass beneath the inverted member 31, the air bubble in its lower end would prevent water from flowing into contact with the dye composition 34. Moreover, if desired, the upper end of partition 36 could be made to extend laterally (to the left in FIG. 2) to engage seam 14 in the space between ports 18 and 19, so that water entering and leaving the container would have to flow beneath the lower end of partition 36.

Also, although the opposed housing sections or walls 12 and 13 have inwardly curved edges, it will be apparent to one skilled in the art that one section could be made perfectly flat and could be seamed to the curved edges of the other section while still maintaining the walls 12 and 13 in spaced, parallel relation. And to make the most effective use of the chlorine tablet, it is advisable that the dispenser be positioned upright near the bottom of a toilet tank, and adjacent the tank outlet, so that most of the chlorine dispensed from container 10 will flow immediately with the flushing water into the associated toilet bowl.

While this invention has been illustrated and described in detail in connection with only certain embodiments thereof, it will be apparent that it is capable of still further modification and that this application is intended to cover any such modifications as may fall within the scope of one skilled in the art, or the appended claims.

What is claimed is:

1. A toilet tank dispenser, comprising a housing disposed to be suspended in a toilet tank, and having in its wall at least one port for admitting water into the interior of the housing when the toilet tank fills, and for permitting part of the water in the housing to be discharged therefrom each time the associated toilet is flushed, a generally cup-shaped member in said housing having therein a water soluble dye, and means in said housing including a water soluble, water-treating tablet releasably holding said member beneath the level of the water in said housing, and in an inverted, inoperative position in which the water in said housing is prevented from coming into contact with said dye, said tablet being disposed eventually to dissolve away after repeated flushing of the associated toilet thereby to release said member, which then floats to an upright position in said housing to allow water therein to contact said dye.

2. A toilet tank dispenser as defined in claim 1, wherein said dye only partially fills said cup-shaped member and leaves therein an air bubble which prevents water in the housing flowing into contact with said dye when said member is in its inverted, inoperative position.

3. A toilet tank dispenser as defined in claim 2, wherein said dye is secured against the closed end of said member.

4. A toilet tank dispenser as defined in claim 2, wherein said dye is supported on a plurality of spaced projections formed around the open end of said cup-shaped member and projecting radially inwardly thereof.

5. A toilet tank dispenser as defined in claim 1, wherein said member is made from a plastic material having a specific gravity such that it normally tends to float upwardly in the water in said housing when said water-treating tablet has been reduced to a predetermined size.

6. A toilet tank dispenser as defined in claim 5, wherein said tablet overlies said member, when the latter is in its inoperative position, and engages and holds said member in its inoperative position until said tablet reaches said predetermined size.

7. A toilet tank dispenser as defined in claim 1, wherein said holding means comprises a pair of spaced partitions formed in said housing and releasably engaged adjacent their upper ends with said tablet to support the latter substantially centrally of the interior of said housing, and said member is positioned in its inverted position between said partitions and beneath said tablet.

8. A toilet tank dispenser as defined in claim 7, wherein said member is generally rectangular in cross section adjacent its open end, and has on its closed end an external, segmental spherical surface.

9. A toilet tank dispenser as defined in claim 7, including a third partition formed in said housing above said upper ends of said pair of partitions and disposed to overlie said water-treating tablet.

10. A toilet tank dispenser as defined in claim 9, including a fourth partition formed in said housing between said tablet and said port and having its lower end spaced from the lower end of said housing to permit water to flow in said housing beneath said lower end of said fourth partition.

11. A toilet tank dispenser as defined in claim 1, wherein said tablet is made from a chlorine base compound and said dye includes solubility and dispersion controlling agents.

12. A toilet tank dispenser, comprising a disposable, plastic housing vented adjacent its upper end, and having between its ends a port for admitting water to and discharging water from, the interior of said housing, when the latter is suspended in a toilet tank with said port located beneath the maximum water level in the tank, means defining an air chamber in said housing, said chamber containing a water soluble indicator adjacent one end thereof, and disposed to be positioned beneath the level of the water admitted to said housing, and means including a water soluble water-treating tablet in said housing operative normally to prevent water in said housing from entering said air chamber, said tablet being disposed eventually to dissolve away after repeated flushings of the associated toilet, and being operative upon being reduced to a predetermined size to permit water to flow into said chamber to dissolve said indicator.

13. A toilet tank dispenser as defined in claim 14, wherein said water soluble indicator comprises a dye composition

14. A toilet tank dispenser as defined in claim 12, wherein said water soluble indicator comprises a perfumed composition which emits a fragrance when dissolved.

15. A toilet tank dispenser as defined in claim 12, wherein said means defining an air chamber comprises a cup-shaped member having said dye mounted therein adjacent its closed end, and having an air bubble in its opposite end, and said means for preventing water from entering said air chamber further includes means for removably supporting said member in an inverted position beneath said tablet until the latter has been reduced to said predetermined size.

* * * * *